United States Patent [19]

Hanna

[11] 4,310,995

[45] Jan. 19, 1982

[54] PANEL ASSEMBLIES AND COMPONENTS

[76] Inventor: Gary D. Hanna, 6 Shamokin Dr., Don Mills, Ontario, Canada, M3B 2V1

[21] Appl. No.: 161,500

[22] Filed: Jun. 20, 1980

Related U.S. Application Data

[63] Continuation of Ser. No. 963,744, Nov. 27, 1978, abandoned.

[30] Foreign Application Priority Data

Sep. 26, 1978 [CA] Canada ..... 312146

[51] Int. Cl.[3] ..... E04C 2/34

[52] U.S. Cl. ..... 52/806; 52/400; 52/823

[58] Field of Search ..... 52/790, 788, 791, 399, 52/400, 821, 823

[56] References Cited

U.S. PATENT DOCUMENTS

| | | | |
|---|---|---|---|
| 2,348,307 | 5/1944 | Richardson | 52/823 |
| 2,708,774 | 5/1955 | Seelen | 52/788 |
| 3,170,456 | 2/1965 | Moss | 52/823 |
| 3,216,166 | 11/1965 | Brown | 52/511 |
| 3,403,476 | 10/1968 | Ciucani | 52/658 |
| 3,426,482 | 2/1969 | Mock | 52/823 |
| 3,871,153 | 5/1975 | Birum | 52/823 |

FOREIGN PATENT DOCUMENTS

| | | | |
|---|---|---|---|
| 29605 | 5/1922 | Denmark | 52/795 |
| 1184817 | 7/1959 | France | 52/790 |
| 628314 | 11/1961 | Italy | 52/790 |
| 7205481 | 11/1972 | Netherlands | 52/789 |
| 3362510 | 7/1962 | Switzerland | 52/788 |

*Primary Examiner*—Price C. Faw, Jr.
*Assistant Examiner*—Henry E. Raduazo
*Attorney, Agent, or Firm*—Murray and Whisenhunt

[57] ABSTRACT

Disclosed is a panel assembly and components therefor. The panel assembly comprises a panel-like body with a groove in the peripheral edge for receiving therein a channel-shaped edge member. The edge member can be a U-shaped cross-section structural member and at least one wall surface of its side walls is provided with serrations.

10 Claims, 9 Drawing Figures

PANEL ASSEMBLIES AND COMPONENTS

This is a continuation application of Ser. No. 963,744, filed Nov. 27, 1978 now abandoned.

This invention relates to panel assemblies suitable for use, for example, as temporary exhibits and room dividers in offices or homes and to components thereof.

Panel assemblies should be of attractive appearance, of adequate strength and not unduly expensive. It is also advantageous if such panel assemblies are also easily movable, and hence should be readily attachable to and detachable from associated support structures, such as posts.

It is therefore an object of the invention to provide an improved panel assembly of the kind indicated above.

It is also an object of the present invention to provide a structural member for use with the panel assemblies as aforesaid.

According to the invention, a panel assembly comprises a panel-like body having a generally rectangular shape with curved corners, the body having a grooved peripheral edge extending therearound, and a metal edge member seated in the groove and extending around the periphery of the body, the edge member being readily bendable and having a channel-shaped main portion in the groove, the channel-shaped main portion comprising a base and opposed side walls, and the edge member may be provided with flanges extending laterally in opposite side walls having respective opposed inner surfaces each with a series of serrations comprising ridges and valleys extending along the walls over the length of the edge member.

Also in accordance with the present invention there is provided for use as a structural member a U-shaped channel of malleable material having opposed side walls and a bottom forming wall, at least one of said side walls having longitudinally extending serrations therein.

Further in accordance with the present invention, there is provided for use as a structural member a U-shaped channel of malleable material having opposed side walls and a bottom forming wall and flanges extending laterally in opposite directions from respective side walls, at least one of said side walls having longitudinally extending serrations therein.

The invention is based, at least in part, on the discovery that it is possible to provide a suitable edge member by extrusion and then bend the member as required to fit the curved corners of the panel-like body without unduly distorting the closely spaced serrations on the opposed inner surfaces of the channel-shaped main portion of the edge member. Such lack of significant distortion is important both from an aesthetic point of view and also since it is convenient to attach a supporting structure to the panel assembly by means of one or more threaded means, such as screws in threaded engagement with the closely spaced ridges, so that the lack of distortion thereof enables such support structures to be readily attached.

Series of serrations may also be provided on the outer surfaces of the walls of the channel-shaped main portion of the edge member, with said serrations on the outer surfaces of the walls engaging respective inner surfaces of the groove in the panel-like body.

The panel-like body may advantageously comprise a pair of spaced wall structures engaging outer surfaces of the walls of the channel-shaped main portion of the edge member, and a honeycomb structure between and secured to said wall structures, said honeycomb structure comprising honeycomb cells each extending in a direction perpendicular to the wall structures.

Each wall structure may comprise at least one layer, which may be single, fibreboard, corrugated sheet in plastic, or corrugated cardboard, and may also comprise an outer layer of flexible material which extends around the edge thereof in engagement with the under surface of the respective flange and the outer surface of the respective wall of the edge member. Each wall structure may also include a layer of foam material beneath the outer layer of flexible material and also extending around the edge of the wall structure.

The present invention will now be described, by way of example, with reference to the accompanying drawings, of which:

Figure 1:
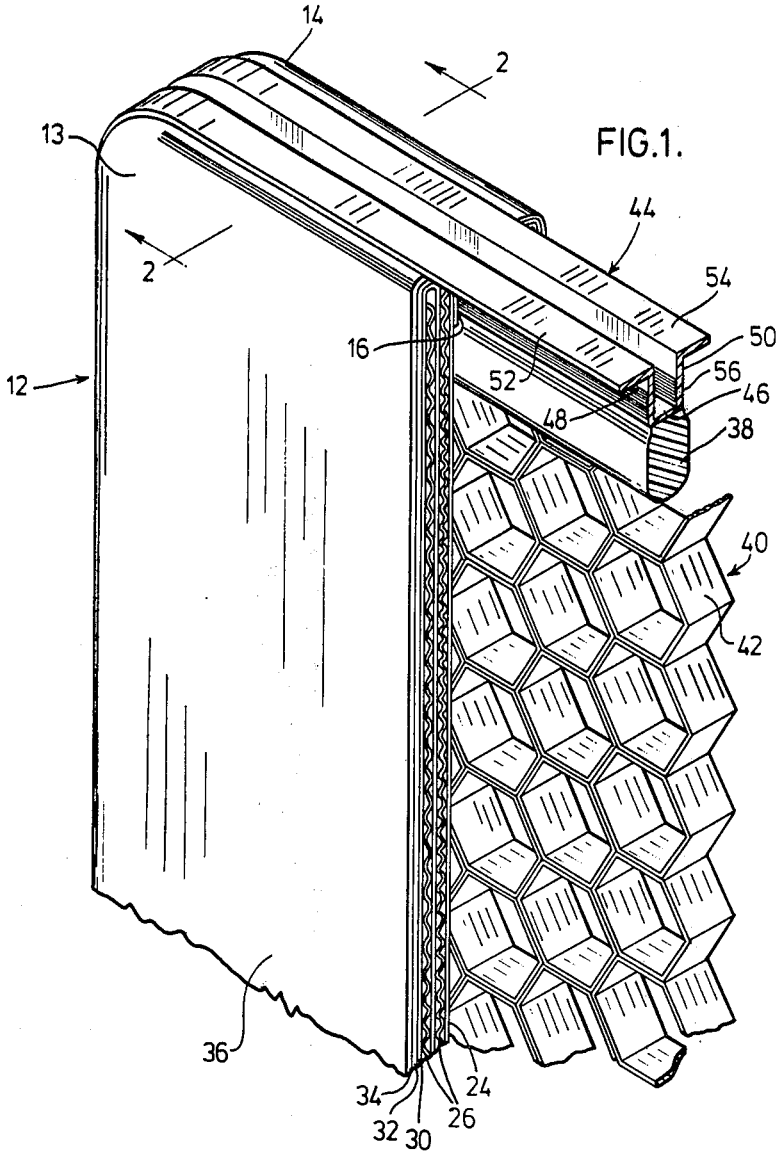
FIG. 1 is a perspective view, partly broken away, of a panel assembly.

Referring to the drawings, a panel assembly suitable for use as a room divider comprises a panel-like body 12 having a generally rectangular shape with curved corners 13 and a peripheral edge 14 with a groove 16 extending around the body.

Figure 2:
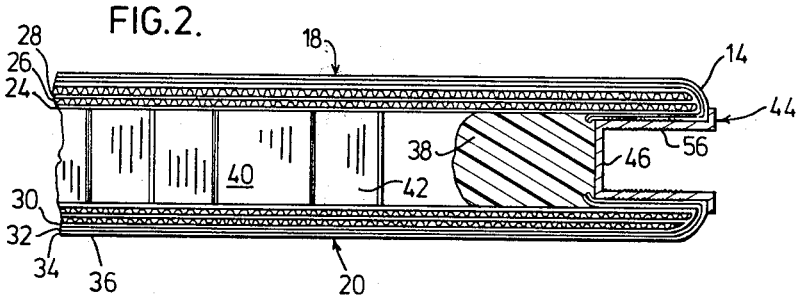
FIG. 2 is a sectional view of the panel assembly taken along the line 2—2 of FIG. 1.

The panel-like body 12 includes two spaced wall structures 18 and 20 (FIG. 2) each wall structure having, from the inside to the outside, a first stiff lightweight cardboard sheet 24, a first sheet of corrugated cardboard 26, a second plane corrugated sheet 28, a second sheet of corrugated cardboard 30, a third plane cardboard sheet 32, an intermediate layer of a flexible material 34 and an outer layer of fabric material 36. Any member layer of each wall structure 18, 20 is secured to another by adhesive. The flexible material layer 34 and the outer fabric layer 36 extend around the peripheral edge 14 into the groove 16, where the outer fabric layers 36 of the wall structures 18, 20 form the interior walls of the groove 16. While fabric is described for layers 36, any other suitable material may be used for appearance and function as required.

The base of the groove 16 is formed by a strip of adhesive foam material 38 which extends completely around the panel assembly and is secured to the first cardboard sheets 24 of the respective wall structures 18, 20 by adhesive.

The two wall structures 18, 20 are spaced apart by a flexible, rigid structure, for example cardboard honeycomb structure 40, and which extends over the whole area of the wall structure except the area immediately adjacent the peripheral edge 14, the honeycomb structure 40 being formed of hexagonal units 42 extending in a direction perpendicular to the wall structures 18, 20. The honeycomb units 42 are secured to one another by adhesive, and the wall structures 18, 20 are also secured to the honeycomb structure 40 by adhesive.

The panel assembly also includes an edge member 44 of extruded aluminum. The edge member 44 has a channel-shaped main portion with a base 46 and opposed side walls 48, 50. The side walls 48, 50 have flanges 52,54 respectively extending in opposite directions from their free ends. The inner and outer surfaces of the side walls 48, 50 each have a series of closely spaced serrations 56 which extend along the walls 48, 50 over the entire length of the edge member 44.

The base 46 and side walls 48, 50 of the edge member 44 are seated in the peripheral groove 16 of the panel-like body 12, with the base 46 being in contact with and secured by adhesive to the foam strip 38, the side walls 48, 50 being in contact with and secured by adhesive to the inturned ends of the fabric layers 36 of the respective wall structures 18, 20 and with the flanges 52, 54 of the edge member 44 engaging the edge 14 of the panel-like body 12.

The serrations 56 on the external surfaces of the walls 48, 50 engage the inturned ends of the fabric layers 36 of the respective wall structures 18, 20 and assist in retaining the edge member 44 in position, with the width of the groove 16 being such that the edge member 44 is a relatively tight fit therein.

The serrations 56 on the internal surfaces of the walls 48, 50 of the edge member 44 enable threaded members to be held in threaded engagement with the edge member 44, for example, in assembling retaining brackets or support structures with the panel assembly in the manner described in patent application No. 963,744 filed Nov. 27, 1978, now abandoned.

It will readily be understood that the described panel assembly is relatively inexpensive, easily constructed and of adequate strength. Also, the outer fabric layer 36 enables the panel assembly to be provided with a finish of attractive appearance and colour. The edge member 44, besides having an attractive appearance, provides rigidity to the panel assembly and, as indicated above, enables attachments to be secured thereto by threaded member bolts engaging with the serrations 56 within the channel-shaped main portion of the edge member 44. The fact that the extruded edge member 44 can be bent to form the corners 13 without significant distortion of the walls 48, 50 and the ridges 56 is advantageous not only from an aesthetic point of view but also in that it is possible to readily attach an item to a corner 13 by means of one or more threaded members.

In FIGS. 3 to 8 various embodiments of the edge member 44 are disclosed.

It will be apparent that the edge member can readily be used as a structural member, either with flanges or without.

Figure 3:
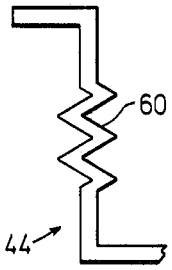
FIGS. 3 to 8 show schematically various embodiments of serrations.
Figure 4:
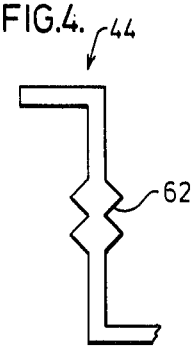
Figure 5:
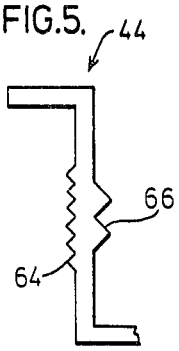
Figure 6:
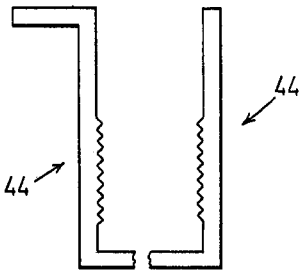
Figure 7:
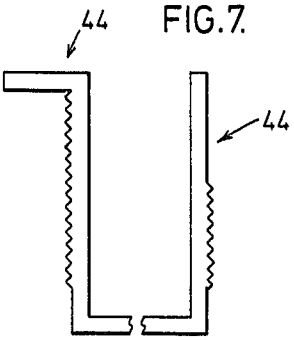
Figure 8:
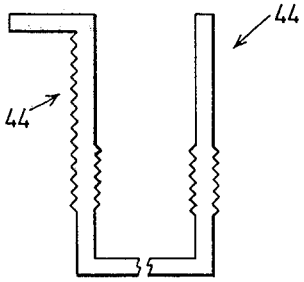
Figure 9:
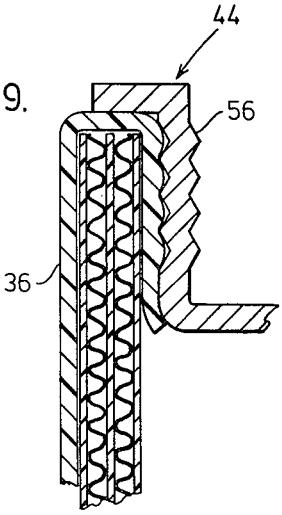
FIG. 9 shows in detail in cross-section the positioning of the outer layer of a panel with respect to the edge member.

The serrations may be somewhat undulating as is indicated at 60 in FIG. 3 or they may be orientated to protrude in opposite directions and with their ridge portions extending along a common axis, as is indicated at 62 in FIG. 4. Similarly, as is shown in FIG. 5, serrations of differing configuration (64, 66) may be employed on the inside surface and the outside surface of the walls of the channel 44. Furthermore, the structural member can comprise serrations on the inside wall only (FIG. 6), with the outside wall being left relatively smooth as provided by the particular manufacturing process that is used for forming the member. Similarly, the edge member 44 can comprise serrations on the outside only as is indicated in FIG. 7. Of course, as is shown in FIG. 8, the edge member can have serrations on the inside and outside wall surfaces, with flanges being provided or dispensed with depending on requirements for a particular application.

It will be apparent that the structural member, which can serve as the edge member, as aforesaid, can be provided by suitable forming operations such as extrusion.

The material of construction for such a structural member can be aluminum or other suitable extrudable material.

As has been indicated, the structural member can readily be bent, for example, to fit the contours of the panel assembly as aforesaid.

Other embodiments within the scope of the invention will be readily apparent to a person skilled in the art, the scope of the invention being defined in the appended claims.

The embodiments of the invention in which an exclusive property or privilege is claimed are defined as follows:

1. A panel assembly comprising a composite panel-like body having a generally rectangular shape with curved corners, the body including two spaced wall structures each comprising at least one panel member of board-like material, the body having a peripheral edge extending therearound, with a groove having a bottom surface in the peripheral edge extending around the body, and a metal framing member seated in the groove and extending around the periphery of the body, said framing member comprising structural framing corner members each comprising first, second and third portions of a U-shaped channel of extrudable metal having opposed side walls and a bottom forming wall and flanges extending laterally in opposite directions from respective side walls, at least one of which side walls has longitudinally extending serrations, the first and second portions being straight and lying to opposite sides of the curved corners with their bottom forming walls at 90° to each other and the third portion being arcuate and joining said first and second portions, the height of the side walls of the first, second and third portions being substantially the same; the first and second portions of adjacent corner members adjoining each other, the wall structures engaging the outer surfaces of the walls and the undersurfaces of the flanges of the framing member.

2. A panel assembly as claimed in claim 1, wherein said side walls have outer surfaces and at least one of the outer surfaces of the walls of the channel-shaped main portion of the edge member is provided with longitudinally extending serrations therein engaging an adjacent wall structure.

3. A panel assembly as claimed in claim 1, wherein said side walls have respective opposed inner surfaces and wherein at least one of said inner surfaces is provided with longitudinally extending serrations therein.

4. A panel assembly as claimed in claim 1, wherein said side walls have respective opposed inner surfaces each having longitudinally extending serrations therein.

5. A panel assembly as claimed in claim 1, wherein said side walls have outer surfaces each having longitudinally extending serrations therein engaging an adjacent wall structure.

6. A panel assembly as claimed in claim 1, wherein said side walls have respective opposed inner surfaces each having longitudinally extending serrations therein and wherein said side walls have outer surfaces each having longitudinally extending serrations therein engaging an adjacent wall structure.

7. A panel assembly as claimed in claim 1, including a honeycomb structure located between and secured to the wall structures, said honeycomb structure comprising honeycomb cells each extending in a direction perpendicular to the wall structures.

8. A panel assembly as claimed in claim 1, wherein each wall structure comprises at least one layer of corrugated cardboard.

9. A panel assembly as claimed in claim 1, wherein each wall structure comprises an outer layer of flexible material extending around the edge thereof in engagement with the undersurface of the respective flange and the outer surface of the respective wall portion of the edge member.

10. A panel assembly as claimed in claim 9, wherein each wall structure also includes a layer of foam material lying beneath the outer layer of flexible material and extending around the edge of the wall structure therewith.

* * * * *